United States Patent [19]

Kane et al.

[11] 3,930,974

[45] Jan. 6, 1976

[54] TWO STAGE SELECTIVE LEACHING OF METAL VALUES FROM OCEAN FLOOR NODULE ORE

[75] Inventors: William S. Kane, Wicomic; Paul H. Cardwell, Zanoni, both of Va.

[73] Assignee: Deepsea Ventures, Inc., Gloucester Point, Va.

[22] Filed: May 21, 1973

[21] Appl. No.: 361,968

Related U.S. Application Data

[63] Continuation-in-part of Ser. No. 272,226, July 17, 1972, which is a continuation of Ser. No. 40,585, May 26, 1970, abandoned, which is a continuation of Ser. No. 247,554, April 26, 1972.

[52] U.S. Cl. ..... 204/105 M; 204/107; 204/108; 204/112; 204/113; 75/117; 75/119; 75/121; 75/101 BE; 75/101 R; 423/24; 423/49; 423/139; 423/140

[51] Int. Cl. ..... C25c 1/10

[58] Field of Search..... 204/105 M, 107, 108, 112, 204/113; 75/117, 119, 121, 101 BE, 101 R; 423/140, 139, 49, 24

[56] References Cited

UNITED STATES PATENTS

| | | | |
|---|---|---|---|
| 3,169,856 | 2/1965 | Moro | 75/119 |
| 3,374,090 | 3/1965 | Fletcher et al. | 75/119 |
| 3,466,169 | 9/1969 | Wonak et al. | 75/112 |

*Primary Examiner*—R. L. Andrews
*Attorney, Agent, or Firm*—Barry G. Magidoff

[57] ABSTRACT

This invention provides a process for selectively removing metal values from ocean floor nodule ore by a two-stage procedure. In the first stage, the ore is leached with an aqueous solution of sulfuric acid or a hydrogen halide to preferentially remove nickel and copper. In the second stage, the ore is leached with a reducing agent to preferentially remove cobalt and manganese. The two leach solutions can then be further treated to separate the individual metal values, e.g., by liquid ion exchange procedures.

25 Claims, 2 Drawing Figures

TWO STAGE SELECTIVE LEACHING OF METAL VALUES FROM OCEAN FLOOR NODULE ORE

This application is a continuation-in-part of co-pending application Ser. No. 247,554 filed April 26, 1972, and of application Ser. No. 272,226, filed July 17, 1972, as a continuation of Ser. No. 40,585, filed May 26, 1970, now abandoned.

It is not a common situation to obtain a relatively valuable nonferrous metal such as nickel, cobalt, copper, manganese, titanium, indium and zinc, from minerals which contain a relatively high proportion of iron. A relatively untapped source of a high-quality manganiferous ore, however, is a material which is found on the ocean floor and has come to be known as ocean floor nodule ore.

With the increased awareness on the part of both the public and the metals industry of the ecological dangers that can arise from continued surface mining of minerals and the increased problems of pollution caused by the refining procedures required for most ores mined from the land, industry has been interested for several years now in the mining of minerals from the sea. This has been an extremely elusive target up to the present. The directions taken have included both attempts to wrest minerals directly from solution in sea water and the mining of ores which are available on the floor of the ocean. These ores do not require any digging into or stripping of the earth's crust; the ocean floor ores can merely be scooped up or in other ways removed from the ocean floor without actually rending the earth's surface.

Ocean floor nodules were first collected in the first half of the 1870's. They have been studied by many workers in an attempt to determine their composition, and after their composition had been determined to try to decipher ways to wrest from their peculiar structure the valuable metals contained therein. It is presently believed that these nodules are actually creations of the sea; they are somehow grown generally in the form of the metal oxides, from the metal compounds which are dissolved in the sea water.

The metal values in the nodules are almost exclusively in the form of the oxides and moreover are present in a very peculiar physical configuration. The physical and chemical structure of the nodules are believed to be a direct result of the conditions under which they were created and to which they have been exposed since their creation. First, the nodules have never been exposed to temperatures other than those at the bottom of the ocean at the location at which they were formed. They have an extremely large surface area, often better than 50% porosity, and they are thus relatively chemically reactive ores.

The nodules are formed as an extremely complex crystal matrix of iron and manganese oxides: tiny grains of each oxide of a size and type which are substantially impossible to separate with present available physical means. These iron and manganese oxides form the crystalline structure within which are held, by means not precisely known, other metal compounds, most likely oxides, including those of nickel, copper and cobalt, as the main ingredients, followed by chromium, zinc, tin, vanadium, and many more elements, including the rare metals silver and gold.

In addition to the crystals of compounds of the valuable metals present, there is also a large quantity of silt, or gangue material, intimately admixed in the nodule ore. This silt, or gangue, is sand and clay, and includes the usual oxides of silicon and aluminum in varying proportions and some carbonates, especially calcium carbonate.

The precise chemical composition of the nodules varies depending upon their location in the ocean. The variation apparently is caused by differences in temperature in various places, differences in composition of sea water perhaps caused by the pressure and temperature variations at different depths and composition of adjacent land areas, variations in the amount of oxygen which is present in the water in different locations and perhaps other variables not readily apparent to observers. Generally, however, in almost all cases the metals which are present in primary proportions are manganese and iron. The following table (taken from an article entitled "The Geochemistry of Manganese Nodules and Associated Deposits from the Pacific and Indian Oceans" by Croonan and Tooms in *Deep Sea Research* (1969), Volume 16, pages 335–359, Pergamon Press (Great Britain) shows the relative compositions of the most valuable metals contained in nodules taken from different areas within the Pacific and Indian Oceans.

Table I

| | 1 | 2 | 3 | 4 | 5 | 6 | 7 | 8 | 9 |
|---|---|---|---|---|---|---|---|---|---|
| Mn | 13.95 | 16.67 | 15.71 | 15.85 | 22.33 | 19.31 | 16.61 | 13.55 | 15.83 |
| Fe | 13.40 | 13.30 | 9.05 | 12.22 | 9.44 | 10.20 | 13.92 | 15.75 | 11.31 |
| Ni | 0.393 | 0.548 | 0.955 | 0.346 | 1.030 | 0.961 | 0.433 | 0.322 | 0.512 |
| Co | 1.127 | 0.395 | 0.213 | 0.514 | 0.192 | 0.164 | 0.595 | 0.358 | 0.453 |
| Cu | 0.061 | 0.393 | 0.711 | 0.077 | 0.627 | 0.311 | 0.125 | 0.402 | 0.330 |
| Pb | 0.174 | 0.034 | 0.049 | 0.035 | 0.028 | 0.030 | 0.073 | 0.051 | 0.034 |
| Bi | 0.274 | 0.152 | 0.155 | 0.386 | 0.381 | 0.145 | 0.230 | 0.145 | 0.155 |
| Mo | 0.042 | 0.037 | 0.041 | 0.040 | 0.047 | 0.037 | 0.035 | 0.029 | 0.031 |
| V | 0.054 | 0.044 | 0.035 | 0.055 | 0.041 | 0.031 | 0.050 | 0.051 | 0.040 |
| Cr | 0.0011 | 0.0007 | 0.0012 | 0.0051 | 0.0007 | 0.0005 | 0.0007 | 0.0020 | 0.0009 |
| Ti | 0.773 | 0.310 | 0.551 | 0.489 | 0.425 | 0.457 | 1.007 | 0.820 | 0.552 |
| L.O.I. | 30.37 | 25.50 | 22.12 | 24.73 | 24.75 | 27.21 | 23.73 | 25.89 | 27.18 |
| Depth (m) | 1757 | 5001 | 5049 | 1146 | 4537 | 4324 | 3539 | 3793 | 5046 |

1. Mid-Pacific Mountains (5 samples)
2. West Pacific (23 samples)
3. Central Pacific (9 samples)
4. Southern Borderland Seamount Province (5 samples)
5. Northeast Pacific (10 samples)
6. Southeast Pacific (8 samples)
7. South Pacific (11 samples)
8. West Indian Ocean (10 samples)
9. East Indian Ocean (14 samples)

Nodules are also found in the Atlantic Ocean; however, it has been found that generally these nodules contain lower amounts of the more valuable metals and correspondingly high amounts of the less desirable metals which cannot be readily refined and which have little or no value; such as the alkaline earth metals.

Because of the peculiar and intricate crystal structure of the ocean floor nodules, the common refining techniques used for refining of land ores are not generally suitable for the nodules.

Mero in U.S. Pat. No. 3,169,856 discloses a scheme for "separating the nickel from the cobalt in ocean floor ore deposits". The Mero process is directed to a specific type of ocean floor nodule ore wherein the separate mineral phases of manganese and iron contain different metal constituents. Specifically, according to Mero nickel and copper are present only in the manganese phase of the material whereas cobalt is present solely in the iron phase. Mero further states that the oxides are in solid solution within the nodule. Mero reacts the nodule ore with a strong reducing agent, for example, $SO_2$ or $NO_2$.

The Mero process is based upon an alleged unique relationship of the metal constituents in being subdivided between the manganese and iron phases. Mero states that as a result of the phase differences in the nodule ores he has tested, it is possible to carry out a process for differentially leaching these materials from the ore. In a first stage, the ore is contacted with an aqueous solution comprising $SO_2$ or $NO_2$ to selectively leach out manganese, nickel, cooper and other mineral elements bound up in the manganese phase of the ore. The cobalt and iron are not leached out. The first solution containing the manganese, nickel and other elements is then treated by various chemical means to separate the different metal values.

Hannay, U.S. Pat. No. 2,259,418, discloses a "continuous cyclic process for the extraction of manganese from its ores". Hannay treats manganese ores containing divalent manganese oxide or divalent manganous carbonate with a sulfuric acid solution obtained from a special type of diaphragm cell for electrolyzing aqueous solutions of manganous sulfate to form the manganese metal Hannay treats the ore with the sulfuric acid to dissolve the manganous compounds present in the ore, with other metals which are in the ore; Hannay next treats the leach solution to remove metals other than manganese and then feeds the manganous sulfate solution into the cathode compartment of the diaphragm-containing electrolytic cell. The cycle is continued with the reacting of fresh ore with the newly generated sulfuric acid and the feeding of the resulting manganous sulfate to the cathode of the diaphragm cell.

It has now been determined that ocean floor nodule ores, containing manganese primarily in the tetravalent state, can be treated by a two-stage leaching procedure to selectively remove, initially, copper and nickel values from the ore with a first aqueous leaching reagent and subsequently, with a second aqueous leaching reagent, to remove manganese and cobalt values. Two separate pregnant leach solutions containing the respective pairs of metal values, can be obtained and can be each readily separated to obtain four separate streams of the individual metal values.

In accordance with the present invention, there is provided a two-stage method for the selective leaching of metal values from ocean floor nodule ores. The ores contain copper, nickel, cobalt, tetravalent manganese and iron, generally the iron is in the trivalent form. The method comprises (1) leaching the nodules initially with an aqueous solution of a mineral acid capable of reacting with the ore to form water-soluble salts of copper and nickel, but which do not reduce tetravalent manganese to divalent manganese, e.g. sulfuric acid or an aqueous solution of a hydrogen halide, especially hydrogen chloride, as well as hydrogen bromide and hydrogen iodide, to obtain a first aqueous pregnant leach solution comprising dissolved copper and nickel salts, i.e. halides or sulfates; (2) separating the pregnant leach solution from the ore solids; (3) separating the individual copper and nickel metal values by selectively extracting at least one of the metal values from the aqueous leach solution to form two separate solutions of the individual copper and nickel metal values respectively, in the form of a water-soluble salt of each; (4) releaching the ore with an aqueous solution of a reducing agent capable of forming a water-soluble salt of cobalt and manganese, respectively, so as to form a second aqueous pregnant releach solution comprising the water-soluble salts of manganese and cobalt; (5) separating the second pregnant releach solution from a solid ore residue; (6) separating the soluble cobalt and manganese compounds from any iron compound; (7) separating out an individual metal value by selectively extracting at least one of the metal values from the pregnant releach solution to form two separate solutions of the individual cobalt and manganese metal values in the form of a water-soluble salt of each; and (8) reducing each of the separated metal values to the elemental metal. The metal values are to be reduced by cathodically electroplating each metal, optimally from its respective aqueous solution.

The separation of the iron compound, step 6, from the dissolved cobalt and manganese salts in the second pregnant leach solution can be carried out simultaneously with the leaching by the second reagent (steps 4 and 5 ) or subsequently. Encompassed within steps 4, 5 and 6 above, are processes wherein the second pregnant leach solution is initially formed including iron as well as cobalt and manganese, dissolved in the water, and the iron is then removed from the solution; also encompassed within steps 4, 5 and 6 are processes wherein the iron is converted to a water insoluble material e.g. iron oxide, during the releaching operation with the reducing reagent while the cobalt and manganese salts are dissolved in water, and the pregnant releach solution separated from the insoluble ore solids which include the insoluble iron material. If an aqueous pregnant leach solution is formed which contains dissolved iron, the iron can be removed by a variety of means including (1) increasing the pH of the solution to above about 2 and passing oxygen therethrough to precipitate the iron as iron oxide; (2) extracting the soluble iron salt from solution, as by liquid extraction, or (3) drying the solution and then converting the iron salt to iron oxide at elevated temperatures of above about 200°C in the presence of water and redissolving the cobalt and manganese salts. The solution of the cobalt and manganese can then be separated into the individual metal values, for example, by liquid ion exchange.

Preferably, the desired individual metal values are separated by selectively extracting one of the metals from each solution in seriatim, and then treating the individual metal values in a known manner to obtain the elemental metal. In a preferred embodiment, the first aqueous pregnant leach solution and the second aqueous pregnant leach solutions are each contacted with a liquid ion exchange medium capable of selectively extracting at least one of the metal values from the solution. The liquid ion exchange medium is separated from the aqueous solution raffinate and the metal value then stripped from the liquid ion exchange medium to form an aqueous solution of the separated metal value.

Preferably, the ocean floor nodule ore is initially comminuted, as in a crusher or grinder, to a size of not greater than about 10 mesh on the U.S. Sieve scale, and preferably of from about 25 to about 100 mesh.

The first stage acid solution can be substantially pure, but preferably is obtained from an aqueous electrolytic cell, such as the manganese sulfate or manganese chloride aqueous electrolytic cell or the nickel sulfate or nickel chloride aqueous electrolytic cell. When the acid is obtained from such a cell, other compounds are present with the acid including a relatively small proportion of the corresponding salt of the electroplated metal, e.g. sulfuric acid mixed with manganese sulfate or nickel sulfate.

The acid electrolyte solution from either type of cell, i.e. nickel or manganese, (the anolyte if the cell is a diaphragm-divided cell) normally contains about 4% by weight of acid, e.g. $H_2SO_4$ or HCl, from the usual commercial cells. However, an acid solution of substantially any concentration of acid can be used if available. Preferably, a concentration of not less than about 2 % by wt. $H_2SO_4$ or 2 % by wt. of HX, wherein X is Cl—, Br— or I—, is used, in order to avoid using too large a volume of leaching solution.

The initial leaching operation with the acid can be carried out at ambient temperatures although temperatures in the range of from about 10° to about 110°C can be utilized, and preferably elevated temperatures of from about 40° to about 80°C. Temperatures of above about 110°C, the normal boiling point are unnecessary, merely increasing the complexity and cost of the operation.

The solid ore remaining following the initial leaching with the acid is almost depleted of nickel and copper. Substantially any reducing agent that is capable of reducing manganese from its tetravalent state to its divalent state and of forming water-soluble salts of manganese and cobalt can be the second leaching reagent. For example, the leached ore can be treated with a solution of sulfur dioxide or ferrous sulfate, a solution of a hydrogen halide (under reducing conditions), especially of hydrogen chloride, or of hydrogen bromide or hydrogen iodide, or of a ferrous halide, especially ferrous chloride. When reacting the ore solids with a hydrogen halide the iron compounds are converted to soluble iron halides, are usually dissolved by the leach liquid and must be removed therefrom as explained above. Preferably, however, the initially leached ore is releached with a solution of a ferrous halide, e.g., ferrous chloride or ferrous sulfate.

The second leaching can be carried out using a mixture of reducing agents. For example, a solution of ferrous sulfate or of ferrous chloride can be contacted with the ore, each alone or in admixture, while passing e.g. either $SO_2$ or HCl through the ore releach solution mixture. Additional gaseous $SO_2$ or hydrogen halide can be bubbled through aqueous solutions of these same materials while releaching.

An advantage to using ferrous halide or ferrous sulfate as the reducing agent is that the iron present in the ore is not dissolved and that such solutions are often available as waste products from acid pickling plants and thus can be extremely economical reagents.

The second pregnant leach solution containing ferric sulfate, manganous sulfate and cobalt sulfate or ferric chloride, manganous chloride and cobalt chloride can be oxygenated and the ferric compound converted to insoluble ferric oxide.

The second leaching of the nodule ore, using the reducing agent, can be carried out at substantially ambient temperatures. The preferred range of operating temperatures is from about 10° to about 110°C; optimum temperatures for ferrous sulfate, ferrous halides, $SO_2$ and sulfurous acid are from about 20° to about 50°C, but for hydrogen halides a temperature of at least about 95°C. Although higher and lower temperatures can be utilized, much higher or much lower temperatures have been found to be unnecessary and therefore uneconomical based on the cost of cooling or heating the reagents. It is only necessary that reducing conditions be maintained.

Generally, sufficient first and second leach solutions should be fed to the ore so as to form solutions which are less than saturated in each of the desired metal values to be dissolved during each procedure. The minimum possible concentration of the metal values is limited by the cost of handling large volumes of dilute solutions.

Each of the two leaching operations can occur in a single stage or in multiple stages. Preferably, several stages, e.g. of mixer-settler stages, are used. However, the design and operation of such contacting procedures and the equipment used therefore is known to the art and does not constitute a feature of this invention.

The two pregnant leach solutions can be separated from any remaining solid residue and finally filtered, if desired, to insure complete removal of all particulate solid matter. The solid residue from the second leaching, as stated above, includes the iron as well as the gangue from the ore.

The pregnant leach solutions can be separated from the insoluble solids by any conventional liquid-solid separation procedure, e.g. filtering or thickening. The two leaching operations and the solid-liquid separations can be carried out batchwise or continuously; continuous countercurrent flow is preferred.

It is important that the iron present in the second pregnant leach solution can be removed prior to further treatment to separate the other metal values in the solution. Iron tends to interfere with the preferred methods for separating and purifying the metal values remaining in the pregnant releach solution.

In carrying out the above leaching and releaching operations, it must be pointed out that the separations usually are not complete. The amount of manganese which is dissolved in the initial leach solution is that which is present in the divalent state. This ranges from zero to about 5% of the total manganese in the ore.

The amount of cobalt which is dissolved by the sulfuric acid or aqueous hydrogen halide, can be, for example, from about 10 to about 20% of the cobalt present in the ore. However, the proportion of cobalt dissolved is such that the cobalt need not be separated from the nickel for some applications of nickel. Thus, for these situations, the separate leaching solution does give a very efficient and economical process, requiring only a relatively simple selective extraction procedure.

For separating copper from nickel, and any small amount of manganese and cobalt, in the initial leach solution, and for separating cobalt from manganese and any small amounts of copper and nickel, in the second leach solution, a liquid ion exchange extraction procedure is most preferred.

The liquid ion exchange extraction procedure requires the use of an extracting medium which is readily separable from water, which comprises an extracting agent selective for extracting one or more of the metal values from the aqueous leach solution and from which the metal value can be readily stripped.

The extracting medium should be immiscible with water to improve the economic efficiency of the process. If the extracting medium were not immiscible with water, a substantial loss of the extracting agent would occur during each extraction, by virtue of at least a partial solubility in the water phase and a loss of the extracting agent in the aqueous raffinate.

Extracting agents which are especially suitable because they are highly specific to the metal values in the leach solutions which are obtained, e.g. from ocean floor nodule ores, include, for example, certain substituted 8-hydroxyquinolines, α-hydroxy oximes and naphthenic acids.

The 8-hydroxyquinoline compounds, which are especially useful for the separation of the metal values in accordance with the present process, can generally be defined by the following formula:

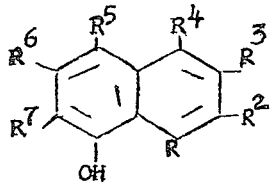

wherein each of the R groups can be hydrogen or hydrocarbyl group or inertly-substituted hydrocarbon groups, such as alkenyl, alkyl, alkynyl, cycloalkyl, cycloalkenyl, aryl or combinations thereof, such as alkaryl, aralkyl, aralkenyl, alkyl-cycloalkyl, etc.

At least one of the R Groups, however, must be a hydrocarbon group. Any inert substituent can be present as long as it does not adversely affect the solubility of the substituted 8-hydroxyquinolines in organic solvents nor adversely affect the solubility in the organic solvent of the metal chelate formed therefrom.

The resulting metal chelate must remain soluble at least to the extent of approximately 2% by weight in the organic solvent.

The preferred position of the hydrocarbyl substituent of the 8-hydroxyquinoline nuclear structure is such as to preferentially complex with the desired metal ion in the aqueous solution. The sum of the carbon atoms in the R Groups must be at least about 8 and can be as high as 24 or more. The preferred R Groups are alkylbenzyl groups or beta-alkenyl groups containing from 12 to 18 carbon atoms, preferably attached at the $R^5$, $R^6$, or $R^7$ position. The optimum position for substitution is at the $R^7$ position to obtain the highest degree of efficiency. For a more complete description of these hydrocarbyl-substituted 8-hydroxyquinolines, see Republic of South Africa specification No. 69/4397 to Budde Jr., et al., assigned to Ashland Oil, Inc.

Representative compounds useful for liquid ion exchange and within the scope of the above general formula are: 7-octylbenzyl-8-hydroxyquinoline, 7-dodecyl-benzyl-8-hydroxyquinoline, 7-nonylbenzyl-8-hydroxyquinoline, 7-ditertiarybutyl-benzyl-8-hydroxyquinoline, 7-hexadecenyl-8-hydroxyquinoline, 7-dibenzyl-8-hydroxyquinoline, 7-dimethyldicyclopentadienyl-8-hydroxyquinoline, 7-phenyl-dodecenyl-8-hydroxyquinoline, and the like where one or more of the hydrocarbyl groups R are attached to ring carbon atoms in the 2nd, 3rd, 4th, 5th and 6th positions. Mixtures of these 8-hydroxyquinoline derivatives can be used if desired.

The second preferred type of metal extracting agents are the alpha-hydroxy oximes, which are disclosed inter alia in U.S. Pat. Nos. 3,224,873; 3,276,863 and 3,479,378. These materials have the general formula:

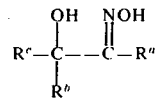

wherein the $R^a$, $R^b$ and $R^c$ groups can be any of a variety of organic, hydrocarbon radicals such as aliphatic and alkyl aryl radicals. $R^b$ can also be hydrogen. Preferably $R^a$ and $R^c$ are unsaturated hydrocarbon or branched chain alkyl groups containing from about 6 to about 20 carbon atoms. $R^a$ and $R^c$ are also preferably the same, but when alkyl are preferably linked to the central carbon atoms by a secondary carbon atom, $R^b$ is preferably hydrogen or unsaturated hydrocarbon or branched chain alkyl group containing from about 6 to about 20 carbon atoms. The oxime preferably contains a total of from about 14 to about 40 carbon atoms. Useful $R^a$, $R^b$ and $R^c$ groups include in addition to hydrogen, the mono-and polyunsaturated groups such as heptenyl, octenyl, decenyl, octadecenyl, octadecynyl, and 2-ethyl-octadecenyl, 1,3-heptadienyl.

Alkyl groups include 2-ethylhexyl, 2,3-diethylheptyl, 2-butyldecyl, 2-butylhexadecyl, 2,4-ethylbutyldodecyl, 4-butylcyclohexyl, and the like. Examples of the preferred alpha-hydroxy oximes include 19-hydroxyhexatriaconta-9,27-dien-18-oxime; 5,10-diethyl-8-hydroxytetradecan-7-oxime; 5,8-diethyl-7-hydroxydodecane-6-oxime.

The above liquid ion exchange agents, which are used for the extraction of copper, cobalt and nickel values, are generally chelates and thus remove only the metal values from the solution, leaving behind the anions.

The above hydroxyquinolines and oximes are compounds generally known to industry and commercially available. Any other compounds useful as selective extractants for the metal values in the aqueous systems obtained from the reduction of ocean floor nodules ores can also be used in the process of this invention.

The extracting agent can be a liquid which is itself water-immiscible but generally can be dissolved in a solvent which is substantially immiscible with water. The oximes and hydroxyquinolines are at least partially insoluble in water. It has been found to be preferable to use them in solution in a water-immiscible solvent to form a water-immiscible extraction medium to prevent loss of the extraction agent in the aqueous raffinate.

It has been found, when utilizing common commercially available water-immiscible solvents, that solutions containing from about 2 to about 50 percent by wt. and preferably from about 5 to about 30 percent by wt. of the extracting agent are economically useful as being sufficiently active to remove the desired metal values selectively from the aqueous solution and being sufficiently dilute in the extracting agent so that substantially no extracting agent is leached out and lost in the aqueous raffinate. If it is desired, however, more concentrated solutions can be utilized. Mixtures of extracting agents can be used as long as they are not jointly reactive and do not interfere with the process of this invention.

Useful solvents include generally any inert hydrocarbons which are solvents for the extracting agent per se, and for the metal chelate, or, extracting agent-metal complex, and which do not react with any of the other materials present, under the conditions of the extraction process. Generally, liquid aliphatic, cycloaliphatic, aromatic, cycloaliphatic-aromatic, aliphatic-aromatic or chlorinated such hydrocarbons are preferably utilized as the solvent for the extracting agent. Optimally, the solvent has a specific gravity in the range of from about 0.65 to about 0.93 and a mid-boiling point in the range of from about 120° to about 615°F. (ASTM distillation). However, substantially any liquid can be used as a solvent that meets the following criteria:

1. A solvent for the extracting agent;
2. A solvent for the extracting agent-metal complex, or chelate;
3. Immiscible with water; and
4. Readily separable from water.

Examples of suitable solvents include benzene, toluene, xylene, aliphatic and aromatic petroleum fractions such as naphtha and derivatives thereof and mixtures of the foregoing. In addition to the aliphatic, aromatic, cycloaliphatic-aromatic, aliphatic-aromatic hydrocarbons and cycloaliphatic hydrocarbons; chlorinated such hydrocarbon liquids can also be usefully utilized.

Light fuel oil, high flash point kerosene and other petroleum hydrocarbons, such as hexane-heptane mixtures are preferred. Generally, the aliphatic materials are most preferred because of their ready availability and ease of separation from the aqueous phase.

The concentration of the extracting agent in the solvent is determined not only by the solubility of the extracting agent per se, but also by the solubility of the extracting agent-metal complex, or chelate.

In addition to the solvent and the extracting agent, there can preferably also be present in the liquid extracting medium a phase modifier which prevents formation of an emulsion with, or entrainment of, the organic phase in the aqueous phase. This is accomplished, it is believed, by altering the interfacial tension and related physical properties of the organic-aqueous mixture during extraction. These phase modifiers are generally most useful when an aliphatic solvent is utilized and include, preferably, aliphatic alcohols containing from about 8 to about 16 carbon atoms such as n-octyl, alcohol, n-decyl alcohol, n-dodecyl alcohol, n-tetradecyl alcohol, n-hexadecyl alcohol, isooctyl alcohol, 2-ethylhexyl alcohol, cyclohexanol and mixtures of these and other alcohols. Decanol is a preferred material.

Generally no more than the necessary amount of the phase modifier, e.g., alcohol, which is necessary to inhibit the formation of the emulsion or prevent entrainment, should be used. Usually no more than about 25% by volume of the phase modifier is necessary. Preferably, from about 2 to about 10% by volume is satisfactory and not more than about 5% is most preferred. The phase modifier can be completely eliminated if desired, and, therefore, is optional in the present procedure.

The present invention does not comprise solely the selection of the extracting medium. It is preferred that the extracting medium be a liquid, because liquid-liquid extraction of a normally solid material from solution is a relatively simple and common procedure. However, other extraction procedures can be followed and other types of extractants used.

When utilizing liquid-ion exchange extraction from an aqueous solution of mixed metal halides, a wide range of aqueous phase-to-aqueous-immiscible-phase volume ratios can be utilized in the present invention. Generally, using a 20% by wt. solution of the extracting agent, aqueous-to-aqueous-immiscible phase volume ratios of from about 10:1 to about 1:10 are desirable.

The above two types of extraction agents are especially preferred for the separation of the metal values found in the leach liquid obtained from ocean floor nodules because it has been discovered, as an aspect of this invention, that a single one of these agents can be utilized for the selective removal of all of the important metal values from the pregnant leach and releach solutions. Thus, by utilizing either an $\alpha$-hydroxy oxime or an 8-hydroxyquinoline, a single extracting medium can be utilized for removing, in seriatim, all of the desired metal values. It is unnecessary to utilize a multiple extractant system when utilizing these materials, but is merely necessary to vary the pH of the leach and releach solutions following each successive extraction.

The first pregnant leach solution contains the dissolved copper salt and nickel salt as its primary solutes. There may also be a small proportion of the manganese salt present, if any divalent manganese was present in the ore, and a small proportion of the cobalt may also have been leached out. The extraction of the desired individual metals, especially the copper and nickel, and the separation thereof, can be carrier out, for example, by the following general procedures, using a liquid ion exchange agent:

1. Adjusting the pH of the first pregnant leach solution to a pH in the range of from about 1.5 to about 2.5, optimally from about 1.8 to about 2.2; the best results for extracting copper being obtained at a pH of about 2 when utilizing an alpha-hydroxy oxime or 8-hydroxyquinoline liquid ion exchange extracting agent as defined above:

2. Mixing the first pregnant leach solution with the water-immiscible extracting medium specific to extracting copper;

3. Separating the aqueous raffinate depleted in copper from the extracting medium phase, now rich in copper;

4. Adjusting the pH of the aqueous raffinate to the range for extracting nickel, using, for example, an alpha-hydroxy oxime or an 8-hydroxyquinoline as defined above; nickel can be extracted at a pH in the range of from about 3 to about 7, and preferably not above about 6, preferred at 3 to 4.5. At a pH of about 7, manganese and cobalt together with the nickel would all tend to precipitate. In those situations where no manganese or cobalt, or any other metal, is present together with the nickel and copper in the pregnant leach solution, there would be no need to extract the nickel; the aqueous raffinate from the copper extraction would be a substantially pure solution of soluble nickel salts.

5. The raffinate from the final nickel extraction, if carried out, can contain small amounts of metals. It may not be economical to attempt to obtain these metal values, however.

Metals other than manganese can be precipitated, for example, by sulfide precipitation utilizing a soluble sulfide salt, such as an alkali metal sulfide or hydrogen sulfide, or by cementation, for example, passing the aqueous solution over a bed of elemental manganese metal. Thus, metals such as zinc and chromium, which may be present in small amounts in the solution, can be removed.

The second pregnant leach solution, which contains large proportions of manganese and a substantially smaller, but still primary, amount of cobalt in solution, can also be treated by liquid ion exchange to obtain the individual metal values.

a. The pH of the second pregnant solution is initially adjusted to about 3.5 to about 7, preferably not greater than about 6 and optimally from about 3.5 to about 5 with the most preferred results being obtained at a pH of from about 3.5 to about 4.5.

b. The second pregnant solution is contacted with an immiscible liquid extracting medium containing an extracting agent specific to cobalt at that pH, e.g. an alpha-hydroxy oxime or 8-hydroxyquinoline, as defined above.

c. The aqueous raffinate from the cobalt extraction is separated from the extracting medium phase.

It is usually necessary to continually add alkaline material during the above extraction stages in order to maintain the desired pH. The extracting agents act by releasing hydrogen ion when extracting metals, and thus the pH would decrease during extraction. Caustic soda solution is preferably used. An alkali metal ion generally does not interfere with the further processing of any metal salt. However, other useful basic materials include generally the oxides, hydroxides and carbonates of alkali metals and of alkaline earth metals. Such compounds include sodium carbonate, potassium hydroxide, potassium carbonate, lithium hydroxide, lithium carbonate and ammonium hydroxide and ammonium carbonate. Manganese hydroxide and manganese carbonate are especially useful because they do not introduce any additional metal values.

The metal-containing extract medium can be stripped of the metal values by contacting with an aqueous stripping solution. Generally an acidic solution is used. Following stripping, the extracting medium can be recycled for additional extraction.

Copper can be readily stripped by any aqueous mineral acid. The amount of hydrogen ion provided by the stripping liquid must be at least slightly in excess (preferably at least about 5% in excess) of the stoichiometric amount needed to substitute for the metal in the extracting medium. Preferably the stripped copper salt is soluble in the stripping liquid. The preferred stripping acids include sulfuric acid, nitric acid, and hydrochloric acid. As the acid used determines the metal salt to be formed, this can be a basis for selecting the acid, if a particular salt is desired.

The nickel can be stripped using a relatively weak acid aqueous solution, such as the mineral acids or the stronger organic acids, such as chloracetic acid, in a concentration of less than about 6N, preferably from about 0.01N to about 3N acid and most preferably from about 0.1N to about 1.0N. Cobalt can be stripped from the extracting medium using a strong mineral acid aqueous solution in a concentration of at least 6N hydrogen ion and 6N chloride ion. Strong hydrochloric acid, containing at least about 20% by weight HCl is preferred. Where cobalt and nickel are both present in the leach solution, they are normally extracted together using the above two extracting agents. They are readily separated by first selectively stripping the nickel with a weak acid and then stripping the cobalt with the stronger hydrochloric acid.

Although the strong acid-chloride solution of cobalt can be directly used for the further reduction to cobalt metal, it is preferred to re-extract the cobalt and then strip again. This can be done by contacting the cobalt-strong hydrochloric acid solution with a tri-alkyl amine, or other material capable of extracting cobalt from an aqueous solution. The amine is preferably dissolved in a water-immiscible solvent to form a solution of the type described above for use with the hydroxyquinolines and oximes.

The tri-alkyl amine solution forms a complex with the cobalt halide and can then be readily separated from the strong acid solution. The cobalt halide can be stripped from the extractant by a weakly acidic aqueous solution, which can be used, for example, as an aqueous electrolyte for refining to the elemental metal by cathodic electroplating.

The aqueous raffinate leach solution remaining after the cobalt has been removed contains substantially all of the manganese value which was leached from the nodule plus minor amounts of the salts of other metals from the nodule ore.

In order to obtain a sufficiently pure stream of manganese salt, it is advisable to separate the other metals from the manganese. This can be done in various ways: "cementation", passing the solution through a bed of manganese metal particles, which results in the removal of the more noble metals by substitution therefore by manganese, or precipitation, as by sulfide precipitation of the other metals present. The remaining manganese salt in solution can then be utilized for the preparation of manganese metal by any conventional means. The presence of alkali or alkaline earth metals results in no interference at this point.

The solutions of the individual metal salts can then be treated in a conventional manner to reduce them to the elemental metals, e.g., by cathodic electroplating techniques. For example, manganese sulfate or manganese chloride can be reduced to manganese in an aqueous electrolytic cell. Copper, nickel and cobalt salts, either sulfates or halides, can be reduced to the metal from aqueous solutions in electrolytic cells. Manganese halide can also be reduced to the metal from the anhydrous fused salt either by electroplating or aluminum displacement. The electrolytic procedures include the conventional methods for electrolytically reducing the salts to the elemental metals and the exact procedure forms no part of this invention. However, preferably, aqueous electrolysis procedures are followed wherein the electrolysis solution comprising sulfuric acid or an aqueous solution of hydrogen halide can be utilized in leaching the copper and nickel, and in stripping the metal value from the liquid ion exchange medium and then can be reused directly, with or without preliminary treatment, in the electrolysis, so as to continuously replenish the supply of electrolyte salt.

It should be noted that under this procedure the electrolyte salt, which is obtained from the liquid ion exchange medium, need not be the original salt produced during the leaching or releaching reactions. The salts formed when the metal values are stripped from the extraction medium depends upon the acid which is used for the stripping.

For a more complete explanation and description of various electrolysis, or cathodic electroplating, refining procedures, see *Graham Electroplating and Engineering Handbook* (1971), for example.

The drawings accompanying this application are schematic flow diagrams of preferred procedures for a two stage leaching of the ore in accordance with this invention.

Figure 1:
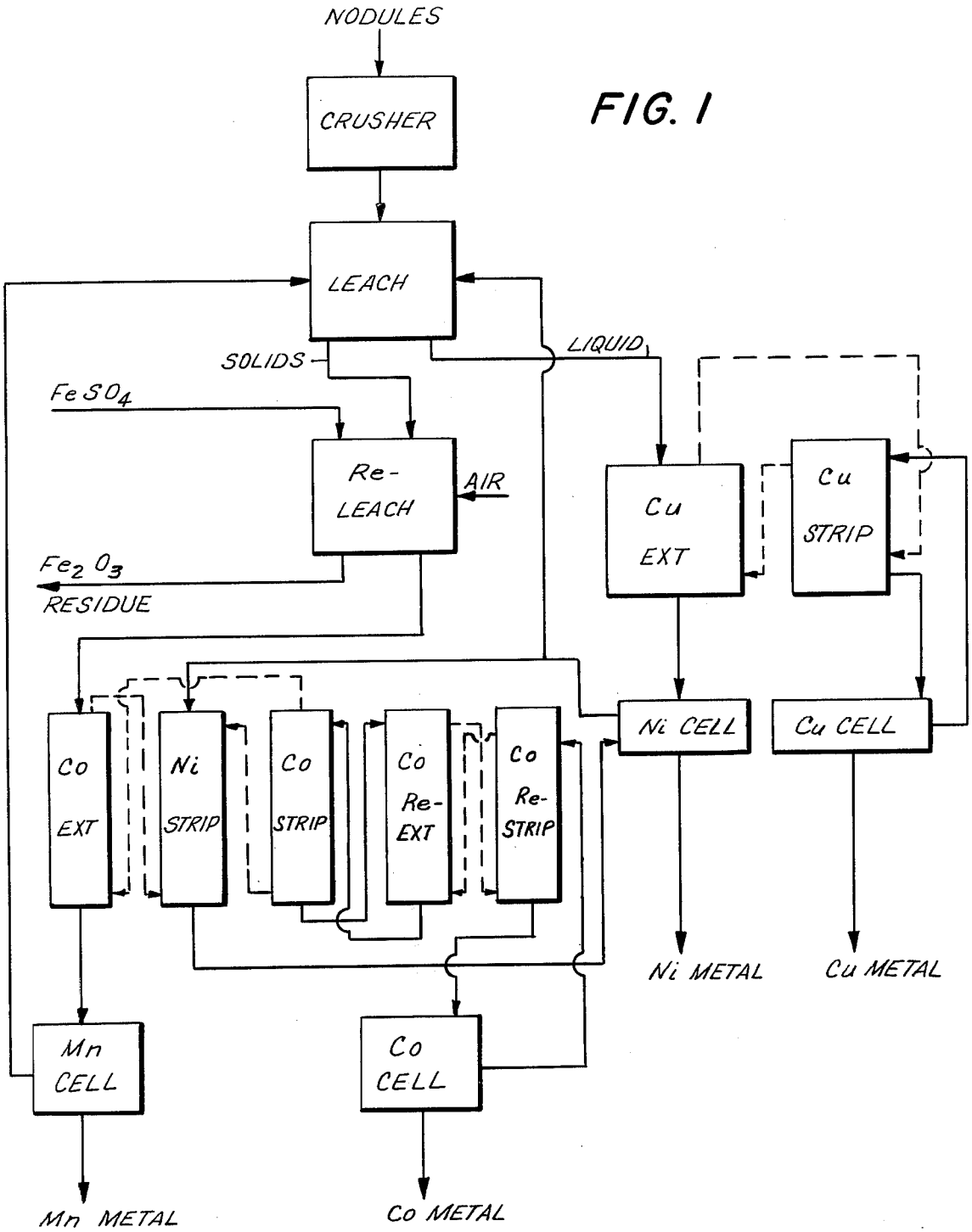
FIG. 1 depicts a process where the separation between nickel and cobalt during leaching is sufficient for the purpose to which the nickel and cobalt are to be put.

Referring to the drawings, ocean floor nodule ore is initially crushed to a particle size of from about 35 to about 100 mesh. The crushed ore is then contacted with an acid solution, e.g. from a manganous halide, or sulfate, aqueous electrolysis cell. The acid solution has a temperature of about 60°C. The solid ore residue separated from the aqueous solution in the leaching step is then passed to a second mixer-settler tank where it is releached again by being passed countercurrently to an aqueous solution of a reducing agent, e.g. $FeSO_4$, while bubbling air through the aqueous solution.

The first pregnant leach solution comprises the soluble salts of primarily nickel and copper. When the electrolysis solution from a manganese cell is utilized, however, there will be manganese salt present in the first pregnant leach solution together with any divalent manganese leached from the ore.

The solid ore residue from the final releach settler stage includes the gangue or ore residue, and iron oxide, e.g. $Fe_2O_3$. The pregnant releach solution comprises primarily salts of manganese and of cobalt dissolved, plus any minor quantities of other metals, including nickel and copper not dissolved during the initial leaching step.

The first pregnant leach solution and the second pregnant releach solution are each extracted in a liquid ion exchange system to separate the individual metals. The pregnant leach solution is initially extracted with a liquid ion exchange agent specific to copper at the pH of the leach solution, approximately 2. The liquid ion exchange agent, e.g. alpha-hydroxyoxime or 8-hydroxyquinoline, is dissolved in an organic medium which is immiscible with the aqueous leach solution.

Referring now to FIG. 1, the raffinate from the copper extraction is sent directly to the nickel electrolysis cell. For the purpose here intended, the nickel thus obtained is sufficiently pure. The spent electrolyte from the nickel cell can be recycled to the first, acid, leaching stage. The pH of the second pregnant leach solution is initially adjusted to a value of from 3 to about 4 and contacted with the liquid ion exchange agent to extract the cobalt, and any nickel, from the second pregnant leach solution. The nickel is first selectively stripped using a portion of the spent nickel electrolyte and fed to the nickel cell. The cobalt is next stripped from the extract with, for example, a 20% HCl solution, which is in turn reextracted and the 20% HCl solution recycled. The reextract is stripped with the electrolyte solution from a cobalt electrolysis cell and the stripping solution forms the feed to the cobalt cell. The aqueous raffinate from the initial cobalt extraction is the feed to the manganese electrolysis cell.

Figure 2:
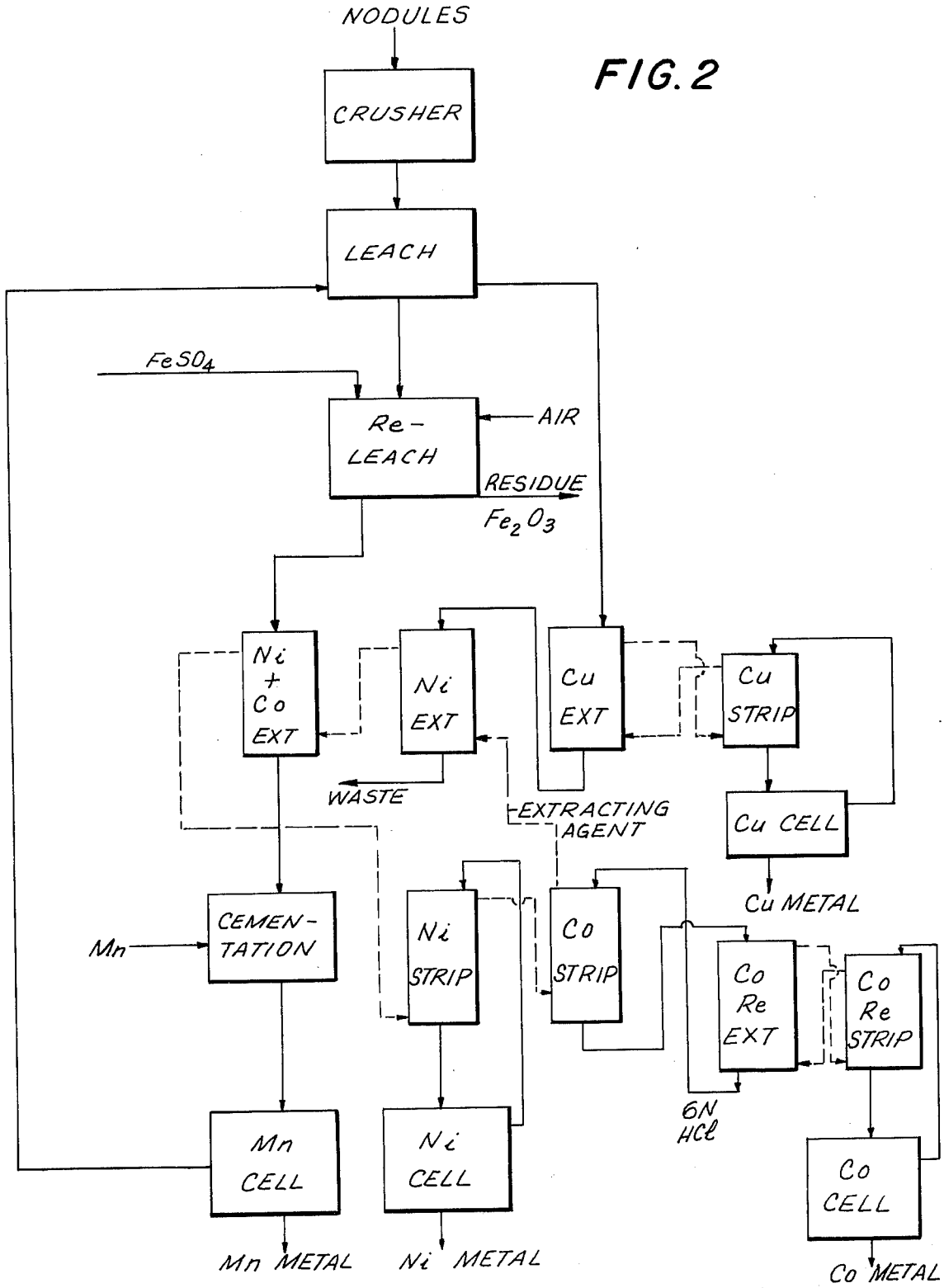
FIG. 2 depicts a process where the nickel and cobalt must be further refined.

Referring now to the alternative embodiment as given in FIG. 2, the pH of the raffinate from the copper extraction is raised to at least about 3 to extract nickel and any cobalt present, and the aqueous raffinate is discarded or mixed with the raffinate of the nickel and cobalt extraction. The pH of the second pregnant leach solution is initially adjusted to at least 3, preferably to from about 3 to about 4 and contacted with the nickel and cobalt-containing extract, from the first leach solution, to extract the nickel and cobalt in the second leach solution.

The extracting medium and the pregnant leach solutions can be contacted in conventional liquid-liquid extraction equipment. Preferably, multi-stage, countercurrent flow extraction is carried out, preferably in multiple mixer-settler stages or in an extraction column. The aqueous raffinate from the initial extraction of the first leach solution is substantially depleted of copper. The aqueous raffinate from the first extraction of the second leach solution is substantially depleted of cobalt and nickel.

The extracting media containing the metal values can be stripped of their metal values, in each case, by countercurrent flow contact in multiple mixer-settler stages or in a column, with aqueous acid solutions having the indicated concentration. For example, copper can be stripped by an acid solution having a hydrogen concentration in an amount to provide at least 5% excess of hydrogen ion required to substitute for the copper, in this case recycled from a copper sulfate aqueous electrolysis cell. The copper value is thus stripped out as copper sulfate which can be directly fed to the electrolytic cell. The extracting medium is then recycled.

Again referring to FIG. 2, the extracting medium separated from the second leach solution, containing nickel and cobalt, is first selectively stripped of its nickel content by the spent electrolyte from the nickel electroplating cell and is next stripped of its cobalt value by contact with an aqueous hydrochloric acid solution having a concentration of hydrogen ion and of chloride ion of at least 6 Normal each.

The highly acidic aqueous stripping solution containing the cobalt, as the only metal value present, is then contacted with a 5 – 30% solution of an organic amine, e.g., tri-isooctylamine, to extract cobalt. Cobalt can be readily stripped from the amine solution using the electrolyte solution from a cobalt chloride cell. The aqueous stripping solution from the amine stripping can be fed directly to the cobalt chloride electrolysis cell. The amine solution and the 6N HCl solution can then be recycled.

The aqueous raffinate from the nickel and cobalt extraction contains primarily manganese. If there are no other metal values present, the raffinate can be fed directly to a manganese electrolysis cell. However, in most cases, there are small proportions of other metals present which are more noble than manganese. These other metals are often not present in amounts sufficient to warrant recovery. They can be removed so that they won't interfere with the electroplating of the manganese from the aqueous solution by, for example, cementation with elemental manganese.

The following examples set forth preferred embodiments of the present invention but are exemplary and not exclusive of the full range of this invention.

EXAMPLE 1

Ocean floor nodule ore was obtained having the following composition:

| COMPONENT | % BY WEIGHT (of metal) |
|---|---|
| manganese | 17.6 |
| iron | 11.6 |
| nickel | 0.61 |
| cobalt | 0.32 |
| copper | 0.1 |

A sample comprising 31 grams of the above nodule ore was ground to an average particle size of less than 50 mesh and initially contacted with 500 milliliters (ml.) of a 4% by wt. $H_2SO_4$ solution at a temperature of 60°C., as a first leach solution. The aqueous solution and ground nodule ore were continuously mixed for a period of 14 hours at the temperature of 60°C., and then the mixture filtered to separate the remaining particulate solids from the pregnant leach solution.

The particulate solids filtered from the first stage leaching step were then mixed in a second stage releaching operation with 500 ml. of a ferrous sulfate solution containing 57 grams $FeSO_4.7\ H_2O$/liter; the liquid and solids were continuously mixed for two hours with a paddle mixer. This mixture was then filtered to separate the second pregnant leach solution from the solid residue. The solid residue was then leached again in a third stage with another 500 ml. of ferrous sulfate solution containing 57 grams $FeSO_4.7\ H_2O$/liter. Air was bubbled through the leach solution in the second and third stages.

The pregnant leach solutions were each analyzed separately to determine the amount of manganese, nickel, cobalt and copper present. The amounts are shown in Table 1, in terms of the percentage of the metal present in the ore.

TABLE I

| Treatment | Percentage Dissolved Manganese | Nickel | Cobalt | Copper |
|---|---|---|---|---|
| 1st Stage 500 mls 4% $H_2SO_4$ for 14 hours | 4.5 | 74.8 | 12.8 | 77.1 |
| 2nd Stage 500 mls of ferrous sulfate solution (57 grams $FeSO_4.7H_2O$) for 2 hours. | 57.7 | 4.8 | 50 | Trace |
| 3rd Stage 500 mls of ferrous sulfate solution (57 grams $FeSO_4.7H_2O$) for 2 hours. | 28.9 | 4.2 | 24.5 | 3.5 |

Both of the second and third steps of leaching were maintained at 82°C.

The first pregnant leach solution had a pH of about 2. The copper was extracted by liquid ion exchange means. The first pregnant leach solution was contacted with a solution comprising 10% by volume of an alpha-hydroxyoxime (5,8-diethyl-7-hydroxy dodecane-6-oxime) known as LIX-64N, 20% by volume isodecanol and a mixed hydrocarbon solvent comprising aromatic and aliphatic petroleum hydrocarbons having a boiling point range of 410°–460°F. and a specific gravity of 0.81.

The aqueous leach solution and the extracting medium were passed countercurrently through three mixer-settler stages at an organic-to-aqueous ratio of 1:1 by volume. The aqueous raffinate from the copper extraction contained substantially all of the nickel value originally present but substantially all of the copper had been extracted. The small proportions of the manganese and cobalt present in the original leach solution were also passed through the extraction stage in the aqueous phase.

Following the separation from the final settling stage, the organic extract was stripped of copper by a sulfuric acid solution from a copper sulfate aqueous electrolysis cell having a hydrogen ion concentration of 3N utilizing countercurrent flow through three mixer-settler stages.

Referring to FIG. 2, the nickel and cobalt can be separated from the leach solution using, if desired, the same LIX 64N extracting medium. The aqueous raffinate from the copper extraction step was adjusted to a pH of about 4.5 by the addition of 2N caustic solution. The resulting aqueous solution was treated in a 3-stage countercurrent, mixer-settler system with the LIX 64N extracting medium and the nickel and cobalt values were extracted. The organic extract phase containing nickel and the small amount of cobalt from the first leach solution is next contacted with the combined leach solutions from stages 2 and 3. This combined pregnant releach solution from stages 2 and 3 comprised substantially all of the manganese from the ore, i.e. 86.6% and most of the cobalt, i.e. 74.5%. There were also a relatively minor amount of nickel and a very small quantity of copper present. The copper was removed from the combined releach solution by cementation. The pH of the combined pregnant releach solution was set at about 4.5 to insure that substantially all of the cobalt and nickel were removed.

The combined releach solution and extract phase are contacted in a 3-stage, countercurrent mixer-settler system to extract the nickel and cobalt from the combined solution. The organic extract phase from the final settler stage contains substantially all of the cobalt and nickel present in all of the three leach solutions, but is substantially free of copper and manganese.

The nickel is stripped from this extract using the spent electrolyte solution from a nickel sulfate electrolysis cell to which sulfuric acid was added to a concentration of hydrogen ion of 3N in order to insure stripping of all of the nickel. The organic liquid and stripping acid are passed countercurrently through three mixer-settler stages at an organic-to-aqueous liquid ratio of 3:1 by volume. Substantially, all of the nickel was removed from the organic phase.

The cobalt was stripped from the organic extract phase by contacting the organic phase with an aqueous solution containing 20% by wt. HCl in a four-stage, countercurrent, mixer-settler system, at an organic-to-aqueous ratio of 3:1. The cobalt was extracted from the 20% HCl solution obtained from the final mixer-settler stripping stage using a kerosene solution containing 10% by volume tri(isooctyl)amine (TIOA) in a three-stage, countercurrent, mixer-settler system at an organic-to-aqueous volume ratio of 2:1. The cobalt was stripped from the TIOA solution utilizing the spent aqueous electrolyte from the cobalt chloride electrolysis cell in a three-stage countercurrent, mixer-settler system at a 1:2 organic-to-aqueous phase volume ratio.

The raffinate from the above cobalt extraction contains primarily manganese sulfate. The raffinate is passed over a bed of manganese metal to precipitate the various other metal values present leaving a substantially pure solution of manganese sulfate. The metals precipitated out by the manganese metal include the small proportions of nickel and copper present in the releach solution and the trace amounts of other metals which were present in the nodule ore and which were releached therefrom.

There were thus obtained, as a result of this process, four separate final streams, each containing a substantially pure soluble metal salt - copper sulfate, nickel sulfate, cobalt chloride and manganese sulfate, respectively. Each of these solutions is then fed to an aqueous electrolytic cell to reduce the salt to the respective elemental metal, i.e., cathodically electroplate the elemental metal.

The advantage of the embodiment of the present invention described in this Example is that the two primary leaching reagents, sulfuric acid and ferrous sulfate, are waste by-products from industrial operations, one of which is the final stage of this process. Such by-products are normally a problem to dispose of, and herein become valuable and useful primary reagents.

EXAMPLE 2

Example 1 above was repeated, but substituting for the LIX 64N extraction medium an extraction medium comprising 10% by volume 7-[3-(5,5,7,7,-tetramethyl-1-octenyl)] -8-hydroxyquinoline, and 20% by volume isodecanol in a kerosene solvent. Similar results were obtained as when using the LIX 64N extraction medium.

EXAMPLE 3

Example 1 above was repeated except that the first leach solution was 500 ml. of an aqueous solution of 3 % by wt. HCl fed at a temperature of 60°C. Substantially the same results were obtained as in Example 1, except that the first pregnant leach solution comprised the chlorides of the metal values leached.

The patentable embodiments of the above described invention are as follows:

We claim:

1. A process for selectively removing metal values from an ocean floor nodule ore, the nodule ore comprising as primary components the oxides of manganese and iron and as secondary components, compounds of copper, cobalt and nickel, the process comprising the steps of (a) leaching the nodule ore with an aqueous solution of a mineral acid, which is capable of reacting with the ore to form water-soluble salts of nickel and copper, without reducing substantially any of the tetravalent manganese in the ore to divalent manganese, selected from the group consisting of sulfuric acid and aqueous hydrogen halide solutions, to form an aqueous solution comprising the dissolved water-soluble salts of copper and nickel; (b) separating the aqueous solution from insoluble ore solids to form a pregnant leach solution comprising the mixed soluble salts of copper and nickel; (c) separating the individual copper and nickel metal values by selectively extracting at least one of the metal values from the aqueous leach solution to form two separate solutions of the individual metal values, respectively, in the form of a water-soluble salt of each; (d) obtaining an aqueous, releach solution comprising dissolved water-soluble salts of manganese and cobalt, substantially free from iron, by the following steps: (i) releaching the insoluble ore solids with an aqueous solution of a reducing agent capable of forming water-soluble salts of cobalt and manganese, and selected from the group consisting of ferrous sulfate, ferrous halides and sulfur dioxide to form an aqueous solution comprising dissolved cobalt, manganese and iron, and, in any chronological order or simultaneously, (ii) separating the aqueous solution from an insoluble ore residue; (iii) oxygenating the aqueous solution to convert the dissolved iron to an insoluble iron oxide, and (iv) separating the aqueous solution from the insoluble iron oxide; (e) separating out the individual metal values from the releach solution by selectively extracting cobalt from the releach solution to form a separate solution of the cobalt value in the form of a water-soluble salt and a releach raffinate substantially free of cobalt; and (f) reducing the individual metal values thus obtained to the respective elemental metals by cathodically electroplating the individual metal values.

2. The process of claim 1, wherein the copper is selectively extracted from the first pregnant leach solution by contacting the first pregnant leach solution with a water-immiscible liquid ion exchange extraction medium selective to extract copper, separating the extraction medium containing the copper value from an aqueous leach raffinate substantially free of copper, and stripping the copper from the extraction medium with an acidic aqueous stripping solution to form a separate aqueous solution of the copper.

3. The process of claim 2, comprising in addition contacting the aqueous leach raffinate solution with a water-immiscible liquid ion exchange extraction medium selective to extract nickel from the leach raffinate, separating the extraction medium containing the nickel from the aqueous solution substantially free of nickel, and stripping the nickel from the extraction medium with a weak acid solution having a hydrogen ion concentration less than about 6N, to form a separate aqueous solution of nickel.

4. The process of claim 3, wherein the weak acid solution is the electrolyte from a nickel sulfate aqueous electrolysis cell.

5. The process of claim 3 wherein the liquid ion exchange extraction medium comprises an extracting agent selected from the group consisting of alpha-hydroxyoximes and the hydrocarbyl-substituted-8-hydroxyquinolines.

6. The process of claim 2, wherein the stripping solution is the electrolyte from an aqueous copper sulfate electrolysis cell.

7. The process of claim 1, wherein the cobalt is selectively extracted from the second pregnant releach solution by contacting the pregnant releach solution with a water-immiscible liquid ion exchange extraction medium selective to extract cobalt, separating the extraction medium containing the cobalt value from an aqueous releach raffinate substantially free of cobalt and stripping the cobalt from the extraction medium with an aqueous solution of hydrochloric acid having a concentration of hydrogen ion and chloride ion of at least 6N each to form a highly acidic solution of cobalt chloride.

8. The process of claim 7 wherein the liquid iron exchange extraction medium comprises an extracting agent selected from the group consisting of alaphahydroxyoximes and the hydrocarbyl-substituted-8-hydroxyquinolines.

9. The process of claim 1, wherein the reducing agent reacts with the cobalt and manganese present in the nodule ore to form the soluble sulfate salts of cobalt and manganese.

10. The process of claim 1, wherein the reducing agent reacts with the cobalt and manganese present in the nodule ore to form the soluble chloride salts of cobalt and manganese.

11. The process of claim 1, wherein the mineral acid is sulfuric acid.

12. The process of claim 1, wherein the mineral acid is hydrochloric acid.

13. The process of claim 1, wherein the individual metal values are cathodically electroplated from an aqueous solution of their individual metal salts.

14. The process of claim 7 comprising extracting the cobalt from the highly acidic solution with an extracting medium, from which the cobalt can be stripped using a weakly acidic electrolyte solution from an aqueous cobalt electrolytic cell, leaving an aqueous raffinate 6N in chloride and hydrogen ion substantially free of cobalt.

15. The process of claim 1, wherein the aqueous solution of the mineral acid is derived from a manganese electrolysis cell.

16. The process of claim 1 comprising in addition treating the releach raffinate with a reagent capable of precipitating metal value more noble than manganese which may be present in the releach raffinate, and separating the precipitated metal value from the aqueous solution comprising soluble manganese salts.

17. The process of claim 1 wherein the reducing agent is sulfur dioxide and the oxygenation occurs simultaneously with the releaching of the insoluble ore with the aqueous solution of the reducing agent and wherein the releach solution is simultaneously separated from the insoluble ore residue and from the insoluble iron oxide.

18. A process for separating metal values from an ocean floor nodule ore, the nodule ore comprising as primary components the oxides of manganese and iron and as secondary components, compounds of copper, cobalt and nickel, the process comprising the steps of (a) leaching the nodule ore with a mineral acid selected from the group consisting of aqueous hydrogen halides and sulfuric acid so as to form an aqueous solution comprising the corresponding water-soluble salts of the copper and nickel present in the nodule ore; (b) separating the aqueous solution from insoluble ore solids to form a first pregnant leach solution comprising the mixed water-soluble salts of copper and nickel; (c) releaching the insoluble ore solids with an aqueous solution of a reducing agent capable of forming water-soluble salts of cobalt and manganese and oxygenating the aqueous solution so that substantially all of the iron is in an insoluble ore residue; (d) separating the aqueous solution from the insoluble ore residue so as to form a second pregnant releach solution comprising water-soluble salts of cobalt and manganese and substantially free of iron; (e) separating out the individual metal values from the pregnant leach solution by selectively extracting the copper from the pregnant leach solution to form a separate solution of a water-soluble copper salt and a leach raffinate; (f) separating out the individual metal values from the second pregnant releach solution by selectively extracting cobalt from the releach solution to form a separate solution of the cobalt value in the form of a water-soluble salt and a releach raffinate; (g) selectively extracting the nickel from the leach raffinate to form a separate solution of the nickel in the form of a water-soluble salt; (h) removing other metal values more noble than manganese from the releach raffinate; and (i) reducing the individual metal values to the elemental metal by cathodically electroplating from the individual metal salt.

19. The process of claim 18, wherein the mineral acid is sulfuric acid and wherein cobalt sulfate and manganese sulfate are dissolved in the second pregnant releach solution.

20. The process of claim 18, wherein the cathodic electroplating of each of the metal salts is carried out in an aqueous electrolyte solution.

21. A process for selectively removing metal values from an ocean floor nodule ore, the nodule ore comprising as primary components the oxides of manganese and iron and as secondary components, compounds of copper, cobalt and nickel, the process comprising the steps of (a) leaching the nodule ore with a mineral acid selected from the group consisting of aqueous hydrogen halides and sulfuric acid to form an aqueous solution comprising the dissolved water-soluble salts of copper and nickel; (b) separating the aqueous solution from any insoluble ore solids to form a pregnant leach solution comprising the mixed soluble salts of copper and nickel; (c) separating out the individual metal values from the pregnant leach solution by selectively extracting the copper from the pregnant leach solution to form a separate solution of the copper value in the form of a water-soluble salt; (d) releaching the insoluble ore solids with an aqueous solution of sulfur dioxide while oxygenating the aqueous solution to form an aqueous pregnant leach solution comprising the water-soluble salts of cobalt and manganese and water-insoluble solids comprising ore residue and iron oxide; (e) separating the releach solution from the insoluble solids; (f) separating out the individual metal values from the releach solution by selectively extracting cobalt from the releach solution to form a separate solution of the cobalt value in the form of a water-soluble salt and a releach raffinate substantially free of cobalt and thus forming four separate aqueous solutions comprising the copper value, the nickel value, the manganese value, and the cobalt value, respectively.

22. The process of claim 21, wherein the reducing agent reacts with the cobalt and manganese present in the nodule ore to form the soluble sulfate salts of cobalt and manganese.

23. The process of claim 21, wherein the mineral acid is sulfuric acid.

24. The process of claim 21, wherein the mineral acid is hydrochloric acid.

25. A process for selectively removing metal values from an ocean floor nodule ore, the nodule ore comprising as primary components, the oxides of manganese and iron and as secondary components, compounds of copper, cobalt and nickel, the process comprising the steps of (a) leaching the nodule ore with an aqueous solution of a mineral acid, which is capable of reacting with the ore to form water-soluble salts of nickel and copper, selected from the group consisting of sulfuric acid and aqueous hydrogen halide solutions, to form an aqueous solution comprising the dissolved water-soluble salts of copper and nickel, without reducing substantially any of the tetravalent manganese in the ore to divalent manganese; (b) separating the aqueous solution from insoluble ore solids to form a pregnant leach solution comprising the mixed soluble salts of copper and nickel; (c) separating the individual copper and nickel metal values by selectively extracting at least one of the metal values from the aqueous leach solution to form two separate solutions of the individual metal values, respectively, in the form of a water-soluble salt of each; (d) releaching the insoluble ore solids with an amount of an aqueous solution of a reducing agent selected from the group consisting of ferrous halides and ferrous sulfate, to form an aqueous pregnant leach solution comprising the water-soluble salts of cobalt and manganese substantially free of dissolved iron; (e) separating the releach solution from any insoluble ore residue; (f) separating out the individual metal values from the releach solution by selectively extracting cobalt from the releach solution to form a separate solution of the cobalt value in the form of a water-soluble salt and a releach second raffinate substantially free of cobalt; and (g) reducing the individual metal values thus obtained to the respective elemental metals by cathodically electroplating the individual metal values.

* * * * *

UNITED STATES PATENT AND TRADEMARK OFFICE

CERTIFICATE OF CORRECTION

PATENT NO. : 3,930,974

DATED : January 6, 1976

INVENTOR(S) : WILLIAM S. KANE, ET AL.

It is certified that error appears in the above-identified patent and that said Letters Patent are hereby corrected as shown below:

Title Page, Section " [63] ", line 3 thereof, delete " which " and substitute therefor -- and --.

Column 18, line 66 (Claim 8, line 1), change " iron " to read -- ion --;

line 68 (line 3), correct " alapha- " to read -- alpha --.

Column 21, line 13 (Claim 25, line 26), correct " leach " to read -- releach --.

Signed and Sealed this

*first* Day of *June 1976*

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

Patent No. 3,930,974 Dated January 6, 1976

Inventor(s) William S. Kane et al.

It is certified that error appears in the above-identified patent and that said Letters Patent are hereby corrected as shown below:

The term of this patent subsequent to March 5, 1991, has been disclaimed.

Signed and Sealed this twenty-second Day of June 1976

[SEAL]

*Attest:*

RUTH C. MASON
*Attesting Officer*

C. MARSHALL DANN
*Commissioner of Patents and Trademarks*